United States Patent [19]

Lofstrom

[11] 4,219,168

[45] Aug. 26, 1980

[54] SLITTING AND REWINDING ASSEMBLY

[75] Inventor: Roger J. Lofstrom, Batavia, Ill.

[73] Assignee: H. J. Ruesch Machine Co., Springfield, Ill.

[21] Appl. No.: 24,091

[22] Filed: Mar. 26, 1979

[51] Int. Cl.[3] ..... B65H 35/02

[52] U.S. Cl. ..... 242/56.2; 242/28.1; 242/75.2

[58] Field of Search ..... 242/56.2, 56.3, 56.4, 242/56.5, 56.7, 56.8, 78.1, 79, 75.2, 75.3, 81; 226/195

[56] References Cited

U.S. PATENT DOCUMENTS

| | | | |
|---|---|---|---|
| 685,879 | 11/1901 | Spaulding | 242/81 |
| 2,275,093 | 3/1942 | Spangler | 242/75.2 X |
| 2,849,193 | 8/1958 | Pauls | 242/78.1 |
| 3,072,309 | 1/1963 | Hill | 242/56.2 X |
| 3,380,686 | 4/1968 | Gaudin | 242/75.2 |
| 3,406,924 | 10/1968 | Bruns | 242/56.7 X |
| 3,559,862 | 2/1971 | Jablix | 226/195 |
| 3,672,595 | 6/1972 | Jablin | 242/56.2 |
| 3,690,583 | 9/1972 | Herman | 242/81 |

*Primary Examiner*—Edward J. McCarthy
*Attorney, Agent, or Firm*—Kane, Dalsimer, Kane, Sullivan and Kurucz

[57] ABSTRACT

A slitting and rewinding system having a tension stand assembly with at least one pressure pad is provided. The system includes a payoff, a slitter, a tension stand, and a coil rewinder. A roll of material, usually metal, is positioned on the payoff so that it is aligned with the slitter. The slitter is fed the material from the payoff and transforms the relatively wide stock into narrow strips. The strips are untensioned between the slitter and tension stand, and may form a loop. Tension is provided between the tension stand and the rewinder due to both the winding action of the rewinder and a pressure pad provided within the tension stand. The pad exerts uniform pressure on the strips as they pass through the stand, thereby helping to form the loop on one side and provide tensioned strips on the other. The system allows a wide metal coil to be processed without difficulty even if there are variations in thickness in the coil. The tension stand may additionally include an elevating mechanism for raising the pressure pad as the diameter of the rewound metal strips increases.

24 Claims, 8 Drawing Figures

SLITTING AND REWINDING ASSEMBLY

BACKGROUND OF THE INVENTION

The field of the invention relates to assemblies for slitting relatively wide coils of material, preferably metal, into relatively narrow strips.

Slitting assemblies have been used to transform wide coils of material, usually metal, into relatively narrow strips. A known system has included a number of different components which cooperate to provide the desired product. A roll of wide stock material is positioned on a fixed or positionable payoff. The payoff may be positioned, either manually or automatically, so that it lines up with a slitter. A Ruesch Model 247 Payoff as produced by the H. J. Ruesch Machine Company of Springfield, N.J. is an example of a payoff which has been successfully employed.

The strip of metal which unwinds from the payoff passes through the rollers of a pulling payoff bridle and into an entry looping pit so that no tension exists between bridle and payoff. It then enters the slitter where it is cut into relatively narrow strips. The driven Ruesch Model 146 slitter is an example of a slitter which is suitable for warehouse duty, and can handle coils up to 48 inches wide with a thickness of 0.125".

An exit looping pit is provided after the slitter such that the narrow strips are not subject to tension between the slitter and a tension stand located after the exit pit. The tension stand tensions the strips before rewinding.

The strips proceed from the tension stand to a rewinder where they may be either traverse (zigzag or oscillated) or pancake wound. The former procedure provides a coil which is several strip widths wide, while the latter provides a coil having a width of only one strip. Traverse winding is often preferred as many more feet of strip material can be included in a roll of given diameter.

The rewinder may be provided with a hydraulic or pneumatic coil stripper to push the finished slit coils off the arbor to a turnstile or other coil receiver. Ruesch Model Numbers 247-N-2551-5882 and 247-N2572-5918 are examples of such rewinders.

Other prior art assemblies have tensioned the strips all the way from the slitter to the rewinder. However, better slitting is accomplished if the metal proceeding through the slitter is not under tension. This is particularly true for thin gauge materials.

A problem which has arisen in previous constructions occurs where the original unslit coil does not have a uniform thickness. The strips which are manufactured from the coil will therefore have varying thickness. When the strips are wound on the rewinder, one or more of the coils of thicker material will have a larger diameter than the others for a given footage of strip material. The coils which become larger in diameter cause the material to wind at a faster speed than others as the rotational velocity for all the coils is the same. As a result some of the strands of thicker material will be tightly wound and strands of thinner material will be loosely wound.

SUMMARY OF THE INVENTION

It is an object of the invention to provide a material slitting assembly which is capable of handling coils of materials which have non-uniform thickness.

It is another object of the invention to provide good slitting, particularly for thin gauge materials.

Still another object of the invention is to provide an assembly which facilitates the edge conditioning of the strips generated by a slitter.

A still further object of the invention is to provide an assembly which permits either the pancake winding or traverse winding of the strips.

The assembly for accomplishing these and other objectives includes a means for supplying relatively wide material into a loop ahead of the slitter, a slitter for cutting the wide material into relatively narrower strips, a tension stand located after the slitter such that the strips are not subject to tension between the slitter and the stand, and a single rewinder positioned after the stand for winding the strips into tight rolls or coils. The tension stand includes at least one pressure pad which frictionally contacts the strips as they pass through. The pad may comprise air actuated rubber boots to assure uniform friction for each strip, and have means for elevating it as the rolls build up on the rewinder. By elevating the pad and its mounting assembly in response to the detected diameter of the rolls, the strips are rewound without any wobble to provide tightly wound rolls. The construction of the assembly insures that the strips will not be under tension between the slitter and the tension stand and that sufficient tension is created between the stand and rewinder to produce firmly wound coils. An edge conditioner may be located in the untensioned area to remove any burrs from the strips.

The rewinder inlcudes a reciprocating arbor or mandrel which allows the traverse winding of the strips. It may also be operated without reciprocation for pancake winding. Means may also be provided for removing the wound coils from the arbor to a turnstile or other receiving means.

DESCRIPTION OF THE INVENTION

Figure 1:
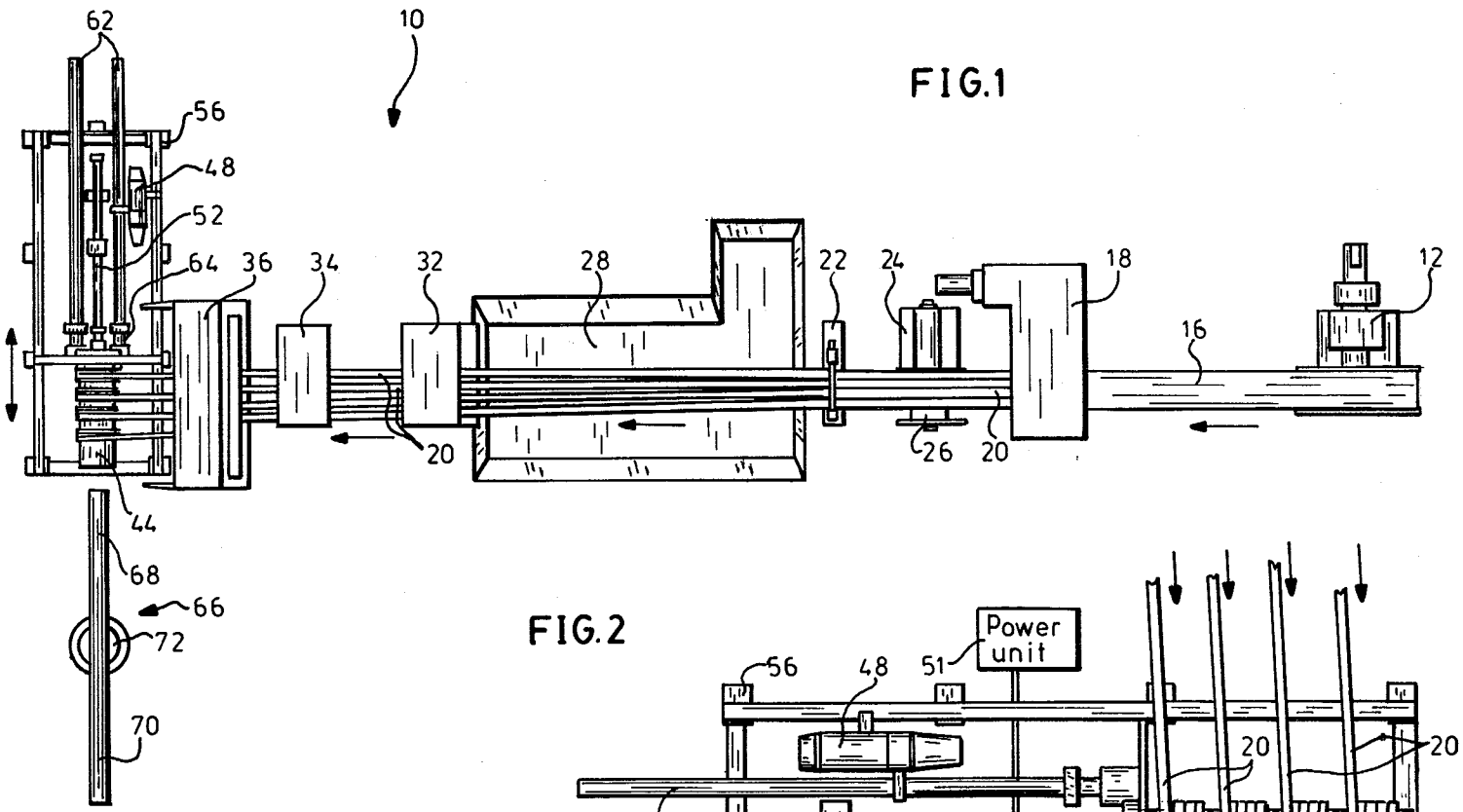
FIG. 1 is a plan view of the slitting assembly.
Figure 3:
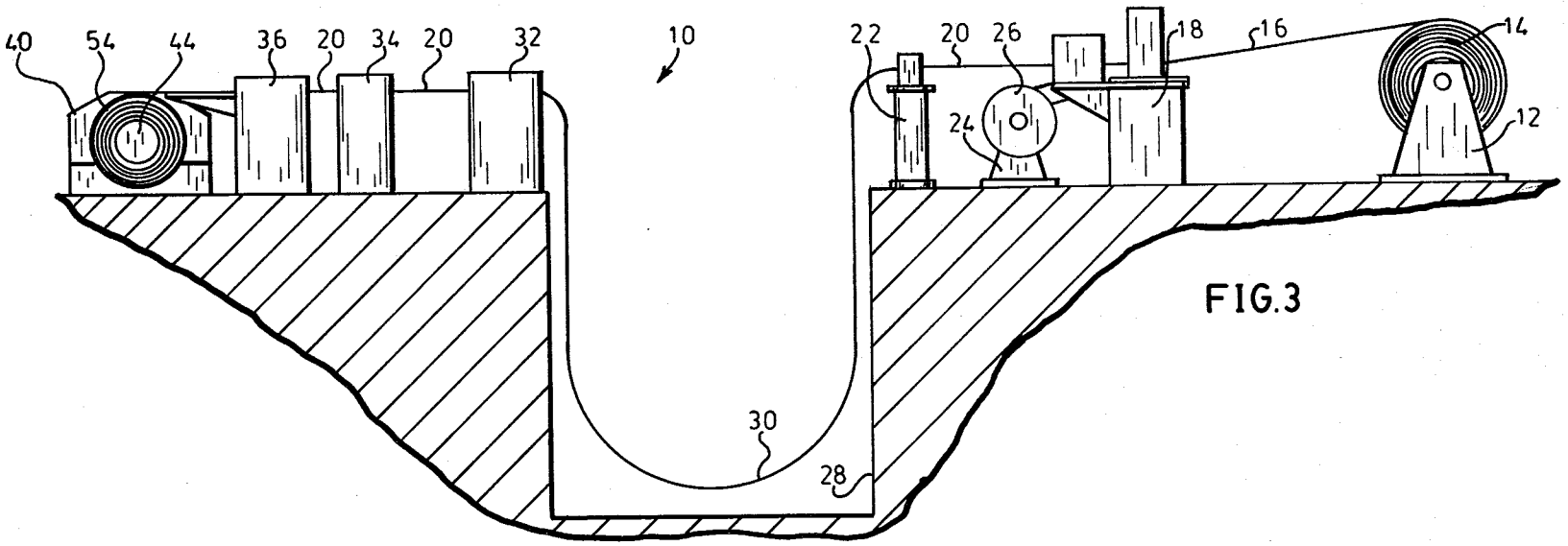
FIG. 3 is a side elevational view of the assembly shown in FIG. 1.

FIGS. 1 and 3 illustrate the basic assembly for the slitting, conditioning, and winding of materials such as metal. The assembly 10 includes a payoff 12 having a payoff mandrel 14 for handling wide coils of metal. The payoff feeds the wide material 16 to a slitter 18. Positioning of the payoff with respect to the slitter can be accomplished either manually or automatically utilizing signals from a photoelectric edge guide.

The slitter 18 includes knife arbors for cutting the wide material into relatively narrow strips 20. The strips 20 pass through a driven exit pinch roll 22. A scrap winder 24 including a scrap winder drum 26 also follows the slitter, and may be separately driven or driven by the same motor which drives the slitter 18.

The strips 20 which exit the slitter 18 and pinch roll 22 proceed to a pit 28 where they form a loop 30. They are also spread apart in this area once they pass through a threading table (not shown). There is no tension on the strips in the pit, and this permits spreading of the strips and consequently allowing wiper unit 32 and edger unit 34 to operate properly. After exiting the loop, the material passes through the wiper unit, then the edger unit trims the edges of the strips 20 to eliminate burrs. Similarly, the strips could be painted, heated and waxed easily after exiting the loop.

Figure 4:
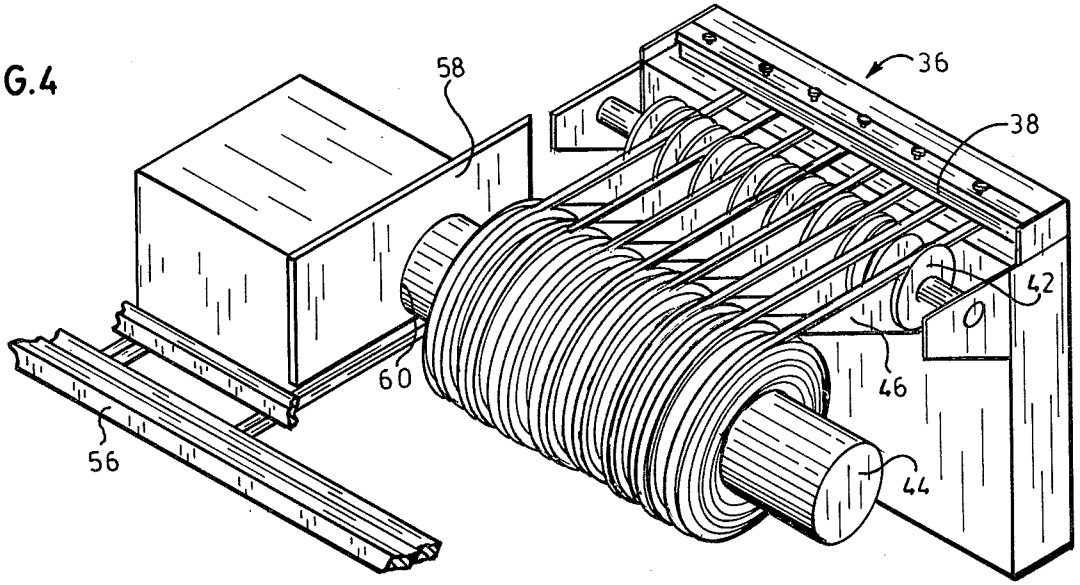
FIG. 4 is a perspective view of the tension stand and rewinder.
Figure 5:
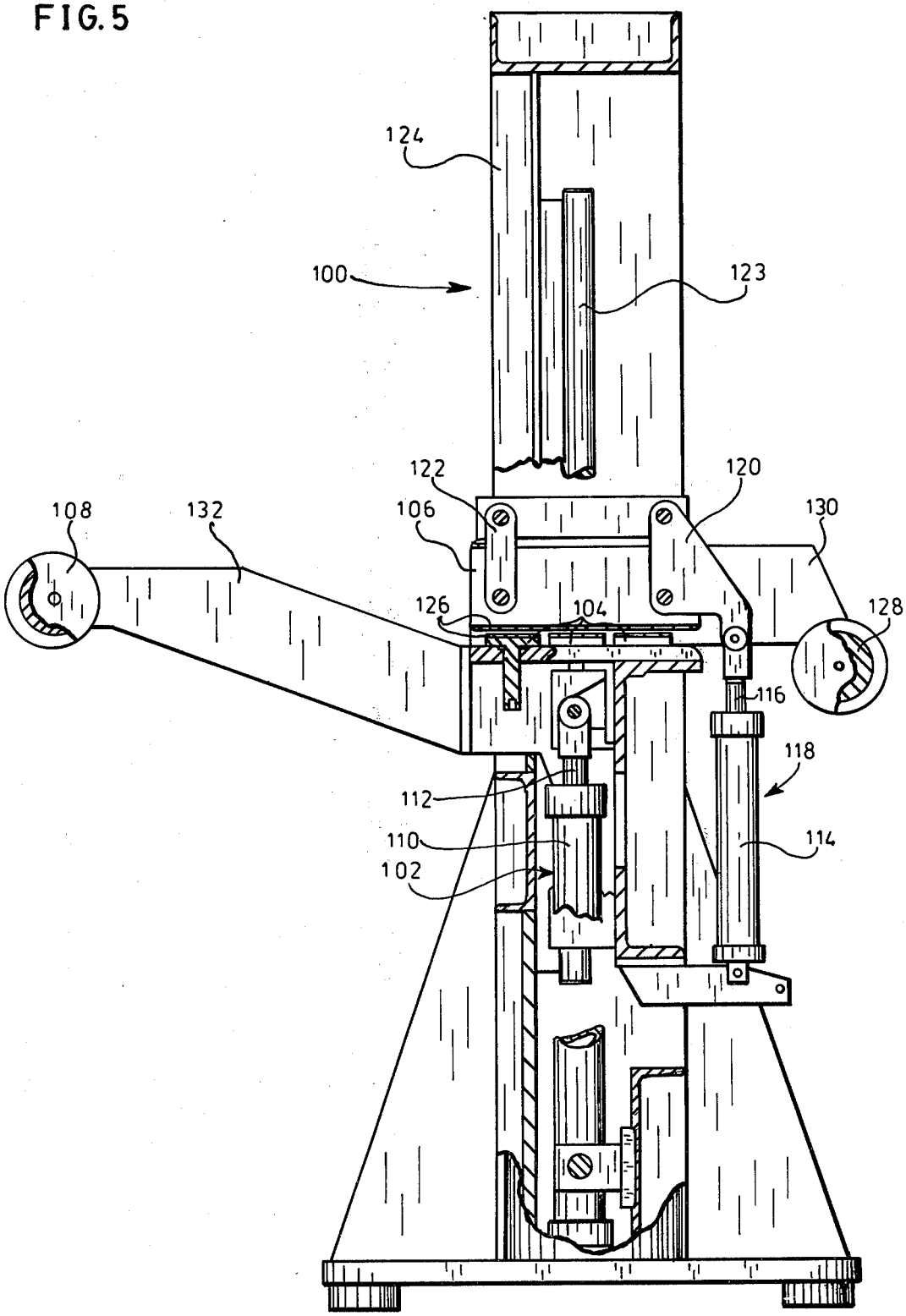
FIG. 5 is a partially sectional elevation view of a tension stand having air actuated rubber boots and elevating means for raising the boots.
Figure 6:
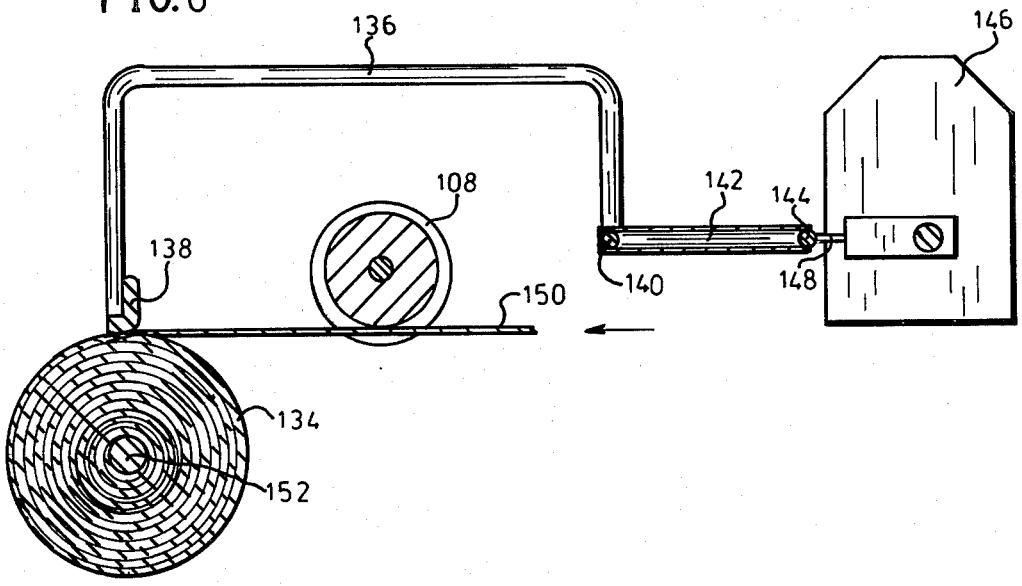
FIG. 6 is a side elevation view of an assembly for sensing the diameter of a coil of rewound strips.
Figure 7:
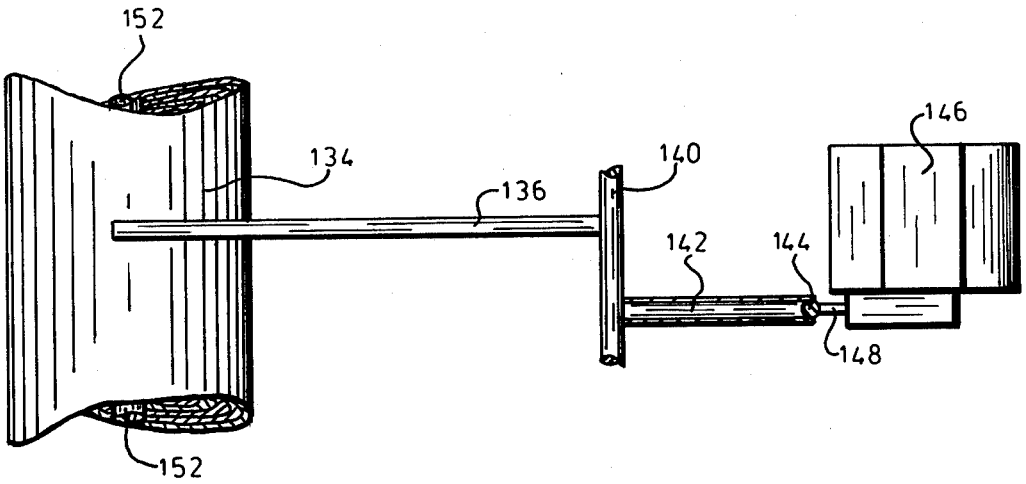
FIG. 7 is a top view of the assembly shown in FIG. 6.

The strips which emerge from the edger unit 34 are received by a tension stand 36. The stand includes at least one pressure pad 38 which is shown in FIG. 4. The pressure pad comprises at least one air actuated rubber boot. The boots exert pressure on the strips 20 as they pass between them and a cooperating surface of the tension stand. Vertical pressure is adjustable (e.g. pneumatically) to increase or decrease friction between the pad and the strips. Means may be provided for elevating the pressure pad as the rolls build up on the rewinder 40. Such means are shown in FIGS. 5–7.

The strips are subject to considerable tension between the tension stand and the rewinder 40. The tension is necessary to insure that the wound package will not fall apart during shipment.

A plurality of spools 42 are provided on the tension stand for directing the separated strips 20 to an arbor 44 on the rewinder. Triangular guides 46 further direct the strips with great accuracy. A motor 48 is secured to the rewinder and provides the power necessary to turn the arbor. A friction belt (not shown) may be utilized to transfer this power. The arbor or mandrel 44 merely rotates if the strips are to be pancake wound.

Figure 2:
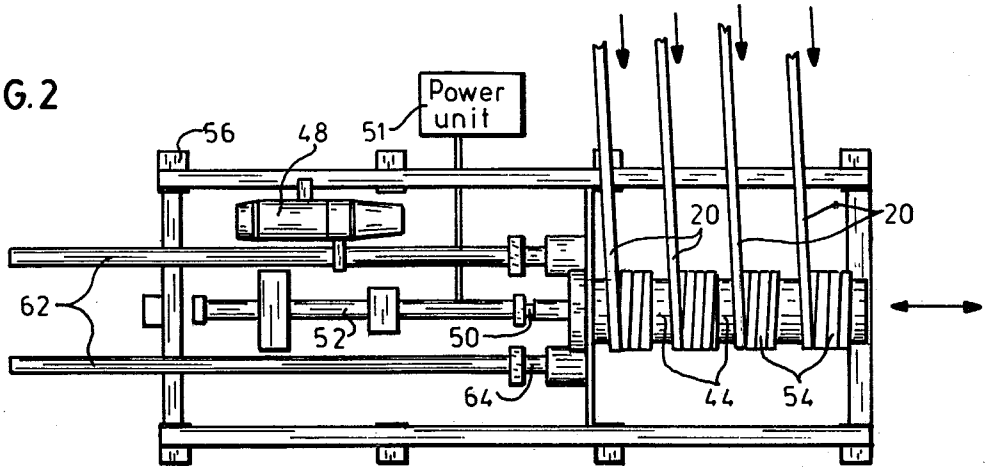
FIG. 2 is an enlarged view of the rewinder shown in FIG. 1.

If traverse wound coils are needed, the arbor moves back and forth due to the operation of a hyrdraulic piston 50 connected thereto. Other devices may be employed for reciprocating the arbor such as a reversing motor and screw arrangement. Fluid lines from a hydraulic power unit 51 are connected to a cylinder 52 which houses the piston, and cause it to reciprocate. The strips are accordingly wound into rolls 54 as shown in FIG. 2. A cam or other mechanical means may alternatively be employed for reciprocation of the arbor. The details of such reciprocating means are unnecessary for providing a complete understanding of the invention.

The rewinder is supported on a chassis 56, and the arbor may be movable with respect to the chassis to facilitate alignment with the tension stand. A coil stripper plate 58 is provided on the rewinder for removing the rewound coils 54 from the arbor 44. The stripper plate has an arcuate lower portion 60 which conforms to the shape of the arbor, and is hydraulically actuated. A pair of hydraulic cylinders 62 having pistons 64 therein enable the rolls to be pushed from the arbor to a turnstile 66 adapted to receive them. The turnstile shown in FIG. 1 has a pair of arms 68, 70 which are rotatable about a pivotal support 72. Once the rolls are pushed upon the arms, the turnstile may be rotated so that they may be removed for storage or shipment.

In operation, the payoff 12 is provided with a roll of wide stock. For purposes of example, it is assumed that a coil of thin gauge sheet metal about 16" wide is utilized. The wide stock 16 is fed to the slitter 18 at the desired speed where it is cut into a plurality of variable width strips. Scrap cuts (selvage) are wound on a scrap winder 24, and the strips 20 proceed to a pinch roll 22. Because the stock and strips are not under tension as they pass through the slitter, proper slitting (i.e. better edging) is insured.

The strips next enter the looping pit 28 where they are realigned to permit reworking by the edger 34. The pressure pad 38 also helps to guide the strips and stabilize them for edge conditioning. After passing through the wiper 32 and edger unit 34, the strips pass under the air actuated rubber boots of the tension stand 36. The tension stand is instrumental in forming the loop 30 within the looping pit 28 so that the slitter 18 may function properly. The pressure pads are adjustable to increase or decrease friction with the strips as they pass through. Even if the strips are of unequal thickness, uniform friction will exist between all strips and the pad. Proper rewinding is accordingly provided even where some strips are of relatively small thickness.

Once the rolls are completed, the stripper plate 58 is hydraulically actuated to remove them from the arbor 44 and onto the turnstile 66. Inexpensive wide stock is accordingly transformed into premium traverse (or pancake) wound narrow strips.

The embodiment shown in FIGS. 5—7 provides further advantages. Referring first to FIG. 5 which shows a tension stand 100, an elevating mechanism 102 is provided for lifting the air actuated rubber boots 104, top platen 106, and guiding spools 108. The elevating assembly 102 includes a cylinder 110 having a hydraulically actuated piston 112 therein. This piston is actuated in response to the detected diameter of the rewound coil strip which is described more fully below. A second cylinder 114 and piston 116 assembly 118 is provided for raising or lowering the platen 106 with respect to the boots 104. Bolt and bracket assemblies 120, 122 are used for securing the piston 116 to the platen assembly.

Other features of the elevating tension stand include a stainless steel bar 123 for guiding the platen/boot assembly as it is elevated within the frame 124. Felt wipers 126 are provided around the platen and boots. Spools 128 are used to guide the strips between the platen and boots. Supporting arms 130, 132, respectively, include spools 128, 108 at their ends. The latter 132 is raised in conjunction with the platen and boots when the elevating mechanism is actuated.

FIGS. 6 and 7 illustrate the detection system whereby the diameters of the rewound coils 134 are sensed. A probe arm 136 having a protective end covering 138 such as felt is in contact with one of the coils 134. As the diameter of the coil increases, it will be appreciated that the probe arm 136 will pivot about a second arm 140. The rotation of arm 140, which is due to the upward movement of the end of the probe arm in contact with the coil, results in the downward movement of a third arm 142 which is rigidly attached to the second arm. The end of the third arm which is furthest from the second includes a pivot 144 which is connected to a conventional valve assembly 146. As this end moves downwardly, connecting rod 148 angles upwardly. The valve will open and supply hydraulic pressure to the elevating mechanism shown in FIG. 5. Piston 112 moves upwardly causing the boots 104, platen 106, and supporting arm 132 to move likewise. When the probe arm 136 again assumes the position shown in FIG. 6, the valve closes and elevation ceases. In this manner, the guide spools 108 are maintained in close promixity to the top of the rewound coils and the metal strips 150 are substantially parallel to the ground as they pass from between the boots and platen to the winding arbor 152. Properly wound coils are accordingly obtained.

Figure 8:
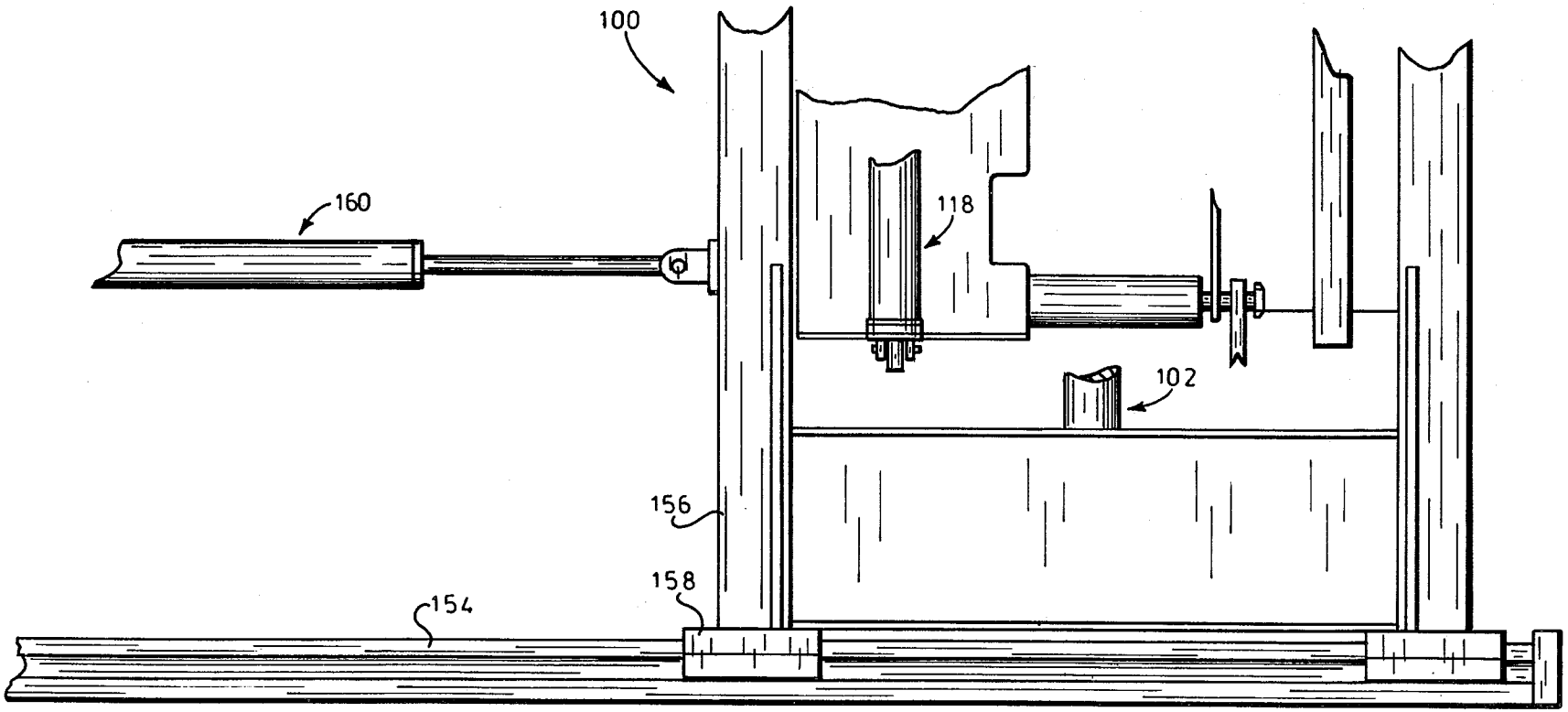
FIG. 8 is a fragmented front view of a tension stand adapted for reciprocal motion.

FIG. 8 discloses an alternative mechanism for traverse winding the metal strips,. Instead of providing a reciprocating arbor, the tension stand 100 may be positioned on tracks 154. The support structure of the stand includes legs 156 having feet 158 adapted for moving within the tracks due to the reciprocal motion of an actuating cylinder and piston assembly 160. The winding arbor does not reciprocate when the arrangement is utilized.

It will be appreciated by those skilled in the art that modifications can be made in the above-described tension stand and slitting assembly without materially departing from the spirit of the invention. The scope of the invention should accordingly be det ermined by reference to the appended claims.

What is claimed is:

1. An assembly for providing rolls of relatively narrow strips from a relatively wide stock material, comprising:

a slitter adapted for cutting relatively wide material into relatively narrow strips;

a tension stand adapted for receiving the narrow strips from the slitter, said tension stand including a pressure pad assembly which applies uniform pressure to the strips as they pass therethrough such that the strips are not subject to tension between the slitter and the tension stand, said pressure pad assembly comprising at least one air actuated rubber boot and a surface opposite said boot, the boot and surface adapted for receiving narrow strips therebetween and applying uniform pressure to the strips; and a rewinder adapted for winding the narrow strips into rolls, said rewinder including an arbor upon which the strips are wound, the strips being under tension between the tension stand and the rewinder due to the action of the pressure pad assembly.

2. An assembly as described in claim 1 wherein the pressure pad assembly is adapted for providing uniform pressure to the strips even if some of the strips are of unequal thickness.

3. An assembly as described in claim 1 further including in combination an edger unit for edge conditioning the narrow strips, said edger unit being positioned between the slitter and the tension stand.

4. An assembly as described in claim 1 further including in combination a looping pit between the slitter and the tension stand, said looping pit adapted for receiving the narrow strips which form loops therein in the untensioned state.

5. An assembly as described in claim 1 wherein the rewinder includes a stripper plate for removing the rolls of strips from the arbor.

6. An assembly as described in claim 1 further including in combination a payoff adapted for feeding relatively wide material to the slitter.

7. An assembly as described in claim 1 wherein the tension stand includes spools for guiding the narrow strips to the rewinder.

8. An assembly as described in claim 1 wherein the slitter is adapted for cutting thin gauge metal.

9. An assembly as described in claim 1 wherein said slitter is adapted for cutting metallic material.

10. An assembly as described in claim 1 wherein the strips between the slitter and tension stand are substantially free of tension, means for permitting the untensioned strips to be spread apart, and means for conditioning the strips in their spread apart state.

11. A method of producing rolls of relatively narrow strips from a relatively wide material, comprising the steps of:

providing relatively wide material to be slit;

cutting said relatively wide material into relatively narrow strips by means of a slitter;

applying uniform pressure to the narrow strips produced by the slitter by means of a pressure pad assembly provided in a tension stand, said pressure pad assembly including air actuated rubber boots capable of applying uniform pressure to said strips even when said strips have different thicknesses;

causing the narrow strips to form loops substantially free of tension between the slitter and the tension stand;

pulling the narrow strips through the tension stand to a rewinder having a rotatagle arbor; and winding the narrow strips on the arbor by rotating said arbor.

12. A method as described in claim 11 further including the step of edge conditioning the narrow strips after they emerge from the tensionless loop.

13. A method as described in claim 11 wherein the strips forming the loop are guided so that they are spread apart and the spread apart strips are then subject to a conditioning operation.

14. A method as described in claim 11 wherein said relatively wide material is a thin gauge metal.

15. A method as described in claim 11 further including the step of reciprocating said arbor to traverse wind the strips.

16. An assembly for providing rolls of relatively narrow strips from a relatively wide stock material, comprising:

a slitter adapted for cutting relatively wide material into relatively narrow strips;

a tension stand adapted for receiving the narrow strips from the slitter, said tension stand including a pressure pad assembly which applies uniform pressure to the strips as they pass therethrough such that the strips are not subject to tension between the slitter and the tension stand;

a rewinder adapted for winding the narrow strips into rolls, said rewinder including an arbor upon which the strips are wound, the strips being under tension between the tension stand and the rewinder due to the action of the pressure pad assembly; and means for elevating said pressure pad assembly as the diameters of the rolls upon the rewinder increase.

17. An assembly for providing rolls of relatively narrow strips from a relatively wide stock material, comprising:

a slitter adapted for cutting relatively wide material into relatively narrow strips;

a tension stand adapted for receiving the narrow strips from the slitter, said tension stand including a pressure pad assembly which applies uniform pressure to the strips as they pass therethrough such that the strips are not subject to tension between the slitter and the tension stand;

a rewinder adapted for winding the narrow strips into rolls, said rewinder including an arbor upon which the strips are wound, the strips being under tension between the tension stand and the rewinder due to the action of the pressure pad assembly; and means for providing reciprocal motion of said tension stand such that strips may be traverse wound on said rewinder.

18. A method for producing rolls of relatively narrow strips from a relatively wide material, comprising the steps of:

providing relatively wide material to be slit;

cutting said relatively wide material into relatively narrow strips by means of a slitter;

applying uniform pressure to the narrow strips produced by the slitter by means of a pressure pad assembly provided in a tension stand;

causing the narrow strips to form loops substantially free of tension between the slitter and the tension stand;

pulling the narrow strips through the tension stand to a rewinder having a rotatable arbor;

winding the narrow strips into coils on the arbor by rotating said arbor; and elevating the pressure pad assembly as the diameters of the coils formed on said arbor increase.

19. A method for producing rolls of relatively narrow strips from a relatively wide material, comprising the steps of:

providing relatively wide material to be slit;

cutting said relatively wide material into relatively narrow strips by means of a slitter;

applying uniform pressure to the narrow strips produced by the slitter by means of a pressure pad assembly provided in a tension stand;

causing the narrow strips to form loops substantially free of tension between the slitter and the tension stand;

pulling the narrow strips through the tension stand to a rewinder having a rotatable arbor;

winding the narrow strips on the arbor by rotating said arbor; and reciprocating said tension stand to traverse wind the narrow strips on said arbor.

20. A tension stand for applying pressure to narrow strips which are to be wound into coils upon a rotating arbor, comprising:

a frame;

a pressure pad assembly mounted upon said frame, said pressure pad assembly including air actuated rubber boots and a platen assembly opposite said boots such that narrow strips may pass therebetween; and means for actuating said pressure pad assembly such that uniform pressure may be applied to narrow strips as they pass through the tension stand.

21. A tension stand as described in claim 20 further including means for elevating said pressure pad assembly.

22. A tension stand for applying pressure to narrow strips which are to be wound into coils upon a rotating arbor, comprising:

a frame;

a pressure pad assembly mounted upon said frame;

means for actuating said pressure pad assembly such that uniform pressure may be applied to narrow strips as they pass through the tension stand;

means for sensing the diameter of a coil being wound upon a rotating arbor;

means for elevating said pressure pad assembly; and means for actuating said means for elevating said pressure pad assembly in response to the sensed diameter of said coil.

23. A tension stand as described in claim 22 further including guide rolls for guiding narrow strips to the arbor after they pass through the tension stand, said guide rolls being attached to said frame and capable of being elevated by said elevating means.

24. A tension stand for applying pressure to narrow strips which are to be wound into coils upon a rotating arbor, comprising:

a frame;

a pressure pad assembly mounted upon said frame;

means for actuating said pressure pad assembly such that uniform pressure may be applied to narrow strips as they pass through the tension stand; and means for providing reciprocal motion of said tension stand.

* * * * *

UNITED STATES PATENT AND TRADEMARK OFFICE

CERTIFICATE OF CORRECTION

PATENT NO. : 4,219,168

DATED : August 26, 1980

INVENTOR(S) : Roger J. Lofstrom

It is certified that error appears in the above—identified patent and that said Letters Patent is hereby corrected as shown below:

Assignee: H. J. Ruesch Machine Co., "Springfield, Illinois" should be --Springfield, New Jersey --; and at Column 6, line 20, "rotatagle" should be --rotatable--.

Signed and Sealed this

*Seventeenth* Day of *February 1981*

[SEAL]

*Attest:*

RENE D. TEGTMEYER

*Attesting Officer*

*Acting Commissioner of Patents and Trademarks*